US007686951B2

(12) United States Patent
Wagner et al.

(10) Patent No.: US 7,686,951 B2
(45) Date of Patent: Mar. 30, 2010

(54) VACUUM SKIMMER FOR PONDS AND THE LIKE

(75) Inventors: Utz Wagner, Münster (DE); Michaela Lorenz, Rheine (DE)

(73) Assignee: OASE GmbH, Hörstel-Riesenbeck (DE)

( * ) Notice: Subject to any disclaimer, the term of this patent is extended or adjusted under 35 U.S.C. 154(b) by 0 days.

(21) Appl. No.: 12/043,981

(22) Filed: Mar. 7, 2008

(65) Prior Publication Data

US 2008/0217229 A1 Sep. 11, 2008

(30) Foreign Application Priority Data

Mar. 9, 2007 (DE) ..... 10 2007 011 972

(51) Int. Cl.
*E04H 4/16* (2006.01)

(52) U.S. Cl. ..... 210/122; 210/167.2; 210/170.05; 210/242.1; 210/242.2

(58) Field of Classification Search ..... 210/122, 210/167.19, 167.2, 170.02, 170.05, 170.06, 210/170.09, 242.1, 242.2
See application file for complete search history.

(56) References Cited

U.S. PATENT DOCUMENTS 2,989,185 A * 6/1961 Lombardi ..... 210/167.2
4,287,060 A * 9/1981 Coggins ..... 210/242.2
4,732,682 A * 3/1988 Rymal ..... 210/242.2
4,746,424 A * 5/1988 Drew ..... 210/167.2
4,900,432 A * 2/1990 Arnold et al. ..... 210/242.1
5,478,473 A * 12/1995 Oshima ..... 210/170.05
5,565,096 A * 10/1996 Phelan ..... 210/170.06
6,274,047 B1 * 8/2001 Bates et al. ..... 210/170.05
6,461,501 B1 * 10/2002 Porter ..... 210/170.02
7,022,223 B2 * 4/2006 Lovestead et al. ..... 210/170.05
2005/0263446 A1 * 12/2005 Beaulieu et al. ..... 210/170
2006/0011555 A1 * 1/2006 Aulniers ..... 210/242.1

FOREIGN PATENT DOCUMENTS

DE 4302978 A1 8/1994

* cited by examiner

*Primary Examiner*—Christopher Upton
(74) *Attorney, Agent, or Firm*—Gudrun E. Huckett

(57) ABSTRACT

A vacuum skimmer for ponds, swimming pools or similar bodies of water has housing with an intake opening and a dirt collecting container arranged downstream for collecting coarse materials. The water to be purified is sucked in through the dirt collecting container by a pump arranged downstream. The intake opening is provided on one housing side. The vacuum skimmer is movable in such a way that the intake opening upon operation of the vacuum skimmer can orient itself in different directions. The vacuum skimmer has an aeration device by means of which air can be blown into the water.

13 Claims, 3 Drawing Sheets

VACUUM SKIMMER FOR PONDS AND THE LIKE

BACKGROUND OF THE INVENTION

The invention relates to a vacuum skimmer for ponds, swimming pools or similar bodies of water or water containers, wherein the vacuum skimmer has an intake opening and a dirt collecting container arranged downstream for coarse materials, through which the water to be purified is sucked by means of a pump arranged downstream.

Such vacuum skimmers by which name they are known in practice serve for removing by suction dirt, for example, leaves, conifer needles, pollen, feathers, floating on a water surface so that the visible dirt is removed and it is prevented that these coarse materials sink to the bottom and enrich the water with too many nutrients so that the water becomes overgrown with algae and turbid. Vacuum skimmers are therefore particularly required for open air bodies of water.

For reasons of simplicity, conventional vacuum skimmers are often mounted rigidly on the edge of the pond or the swimming pool and have an opening facing the body of water through which the surface water is sucked in by means of a pump arranged downstream so that the dirt is collected in a dirt collecting receptacle. Sometimes the arrangement of the vacuum skimmer on the edge of the pond is not possible for visual reasons or because of the landscape conditions and sometimes also not expedient because of the geometry of the body of water. In these cases, vacuum skimmers are used that can be utilized at any desired location, for example, in the middle of the pond and therefore can suck in surface water from several directions. These vacuum skimmers have an annular intake opening. For adjustment to the water level, the intake rim is provided on a pipe that is height-adjustable relative to the remainder of the device. Such vacuum skimmers are either installed by means of a support leg on the bottom of the pond, or are floating devices as disclosed, for example, in DE 43 02 978 C2. As a result of leakage, caused by the height-adjustable pipe, pressure losses occur so that the efficiency is not optimal. In particular in the case of such floating vacuum skimmers, canting of the height-adjustable pipe can occur as a result of movement, possible air or water currents, or similar effects so that the suction action is no longer optimally uniform or it can even happen that the device will capsize. Moreover, the vacuum removal of dirt has been found to be unsatisfactory for maintaining the desired water quality.

SUMMARY OF THE INVENTION

It is an object of the invention to provide a vacuum skimmer that avoids the aforementioned problems and is suitable to further improve the water quality.

According to the invention, this object is solved by a vacuum skimmer in that the intake opening is provided on one housing side, the vacuum skimmer is designed to be movable in such away that the intake opening upon operation of the vacuum skimmer can orient itself in different directions, and the vacuum skimmer has an aeration device by means of which air can be blown into the water.

By combining the skimmer function of the vacuum skimmer and an aeration device, dirt is removed from the water while at the same time the water is enriched with oxygen; this additionally improves the water quality. In that, on the one hand, the intake opening is arranged at only one housing side and, on the other hand, the vacuum skimmer is not rigidly installed but movable, in particular also designed or arranged so as to be rotatable, dirt removal by suction is enabled from various areas of the body of water. For this purpose, the vacuum skimmer can either rotate freely at least about its central axis so that the intake opening during the course of use can orient itself in different directions or the position of the intake opening can also be actively changed. This can be realized directly or indirectly by time control, for example, by means of a motor drive or also by spring tension.

Preferably, the intake opening has an intake flap provided laterally on the housing; instead of, as in the prior art, across the rim of a pipe body, dirt floating on the surface can be removed by suction with little loss through the intake opening defined by the intake flap. Accordingly, an inadequate suction action caused by canting, tilting or slanting is not possible for a vacuum skimmer according to the invention. The adjustment to the existing water level is realized automatically in that the intake flap with its upper edge is connected height-variably to the housing. This is effected in an especially simple and reliable way with regard to manufacturing technology by a pivotable connection of the intake flap in the lower area.

The vacuum skimmer according to the invention can be secured, for example, by means of a support leg on the bottom of the body of water. This installation must be realized in such a way that the intake opening of the vacuum skimmer is able to orient itself in different directions, for example, at least by means of a rotatable attachment of the vacuum skimmer. Preferably, the vacuum skimmer is however designed in a self-supporting way, i.e., it floats on water so that it can either drift freely on the surface or its movement radius can be limited by an additional anchoring to the bottom.

BRIEF DESCRIPTION OF THE DRAWINGS

Further advantages and details of the invention result from the dependant claims and an embodiment illustrated in the drawings which will be explained in the following.

DESCRIPTION OF PREFERRED EMBODIMENTS

Figure 1:
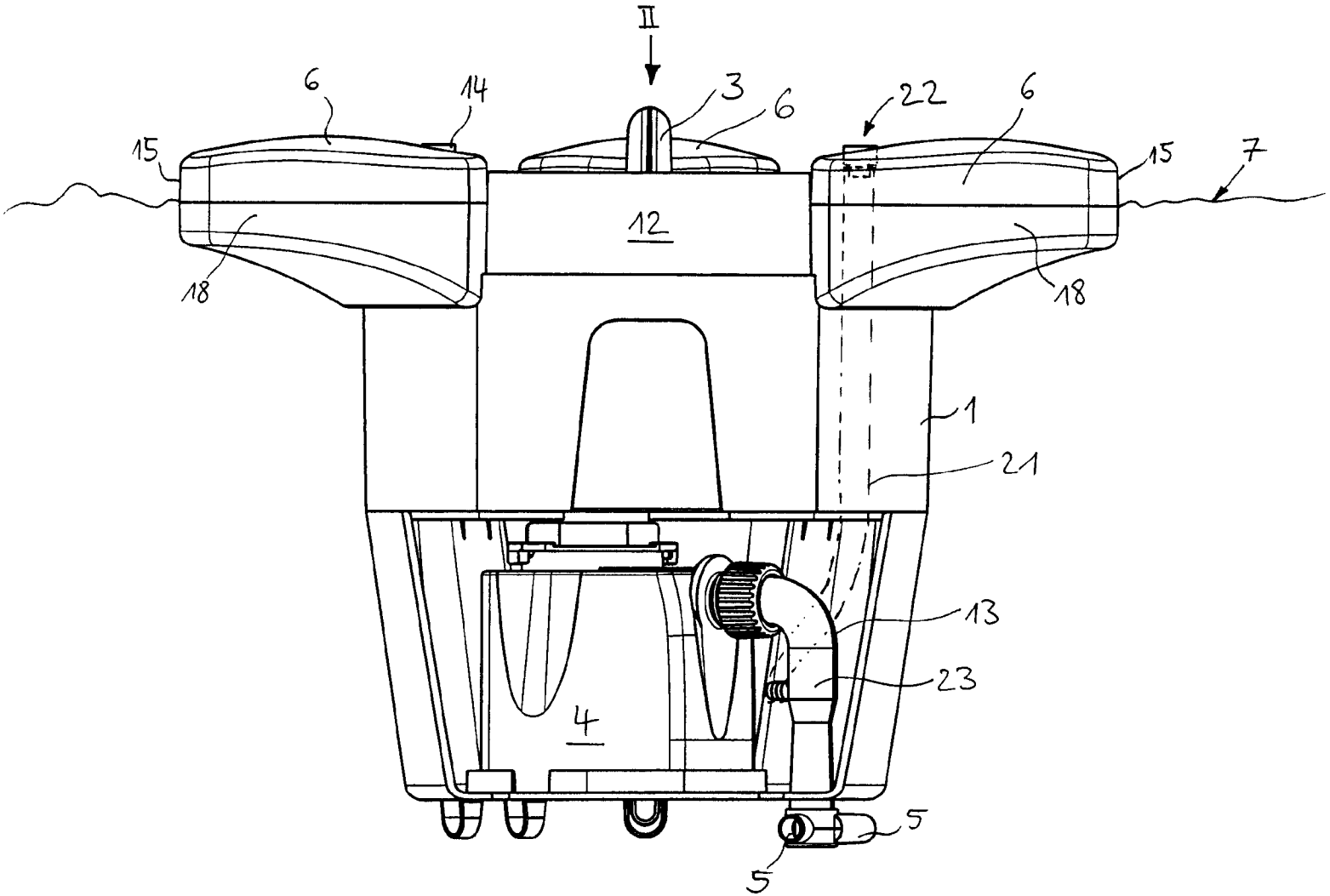
FIG. 1 shows a vacuum skimmer in a side view.

The illustrated surface vacuum skimmer has a housing 1 having in its upper area a dirt collecting container 2 that with the aid of the handle 3 can be easily removed upwardly for emptying it. In a housing part arranged below the dirt collecting container 2, a pump 4 is integrated in the illustrated embodiment so that the device operates as an independent filtering device. Moreover, coarse, fine and/or very fine filters as well as biological purifying devices, for example, a UVC lamp (ultraviolet C), can be provided (not illustrated separately) and integrated into the device; optionally, they can be arranged in the housing 1 or in the pump device 4. The pump 4 has one or several suction intakes (not illustrated) that can also be provided in the form of surface openings of the pump. The water outlet 5 returns the filtered water to the environment so that by means of the vacuum skimmer a circulation action is also provided.

The illustrated embodiment is designed to be self-supporting on water and floats by means of the provided float bodies 6 on the water surface 7. The selected embodiment with three float bodies 6 arranged at an angle of 120 degrees relative to one another, respectively, ensures a safe and stable floating position of the vacuum skimmer. Since the float bodies 6 are relatively far-reaching, they can be removed for transport and storage purposes. They are preferably inserted with projections 10 provided for this purpose into matching recesses 9 shown in FIG. 3 and illustrated in dashed lines in the form of a housing wall 8 in FIG. 2. Between the projections 10 and the housing 1 a locking connection 11 is preferably provided that, if required, can be released from the interior.

Figure 2:
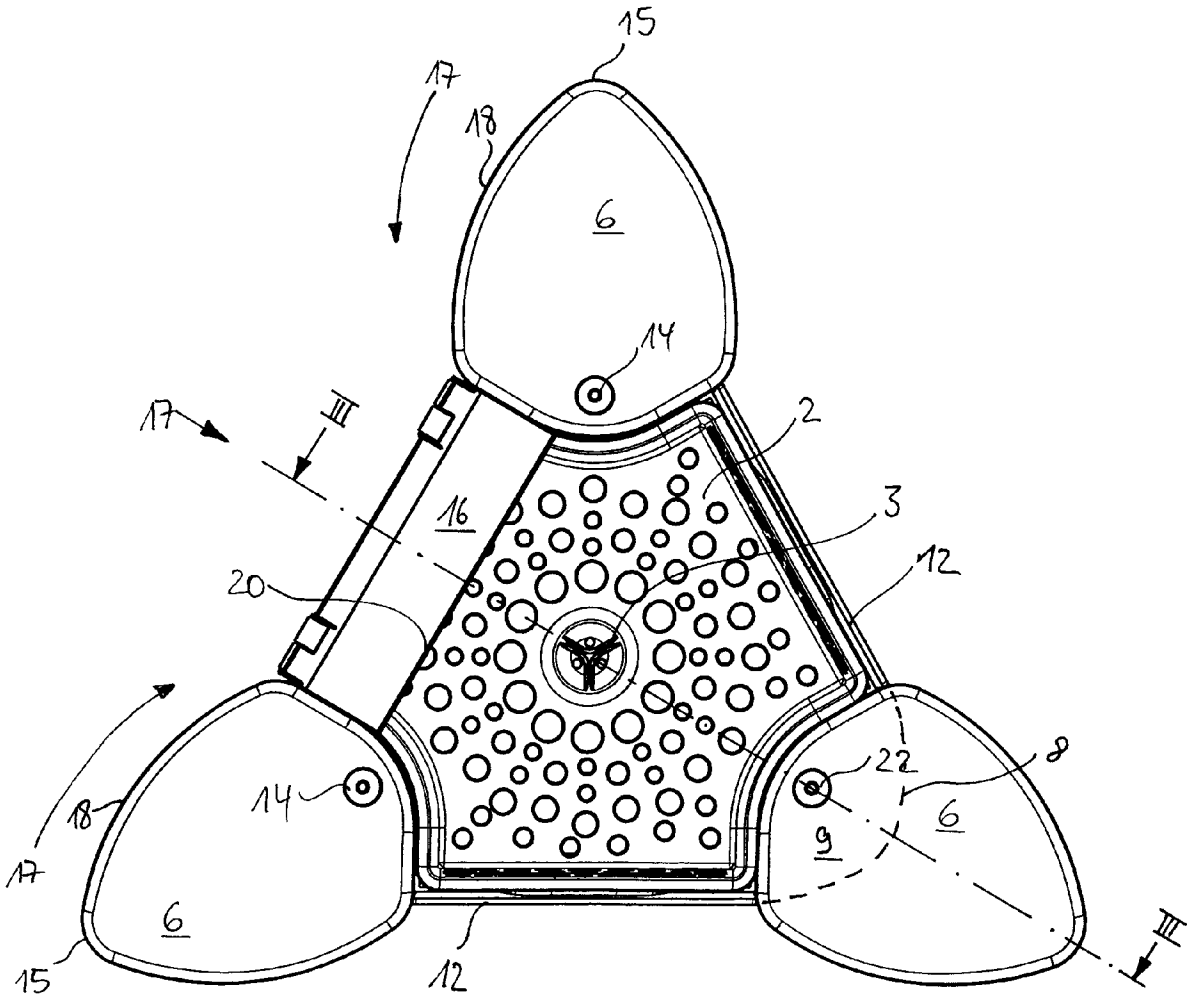
FIG. 2 is a plan view in the direction II onto the object of FIG. 1.

The float bodies 6 are designed, at least in the plan view of FIG. 2, similar to the shape of a ship's bow with outwardly projecting tips 15, i.e., they have a biconvexly pointed shape with convex sides 18 as shown in FIG. 2. In this way, they can fulfill in an especially suitable way the function of a flow guiding element and deflect the water flow resulting from the vacuum action of the pump to the intake flap 16 that is substantially arranged laterally relative to the dirt collecting container 2. The water flow flowing against the intake flap 16 is symbolized by arrows 17. On the other two sides of the housing 1 between the float bodies 6 rigid housing walls are provided; water cannot flow through them into the dirt collecting container 2.

The intake flap 16 in the illustrated embodiment is supported on the housing 1 so as to swivel about axis 19; in this way, upper edge 20 of the intake flap 16 is height-adjustable by pivoting to different positions relative to the housing 1. For illustration purposes, FIG. 2 shows the intake flap 16 almost completely pivoted inwardly while FIG. 3 illustrates the flap in upright position.

Figure 3:
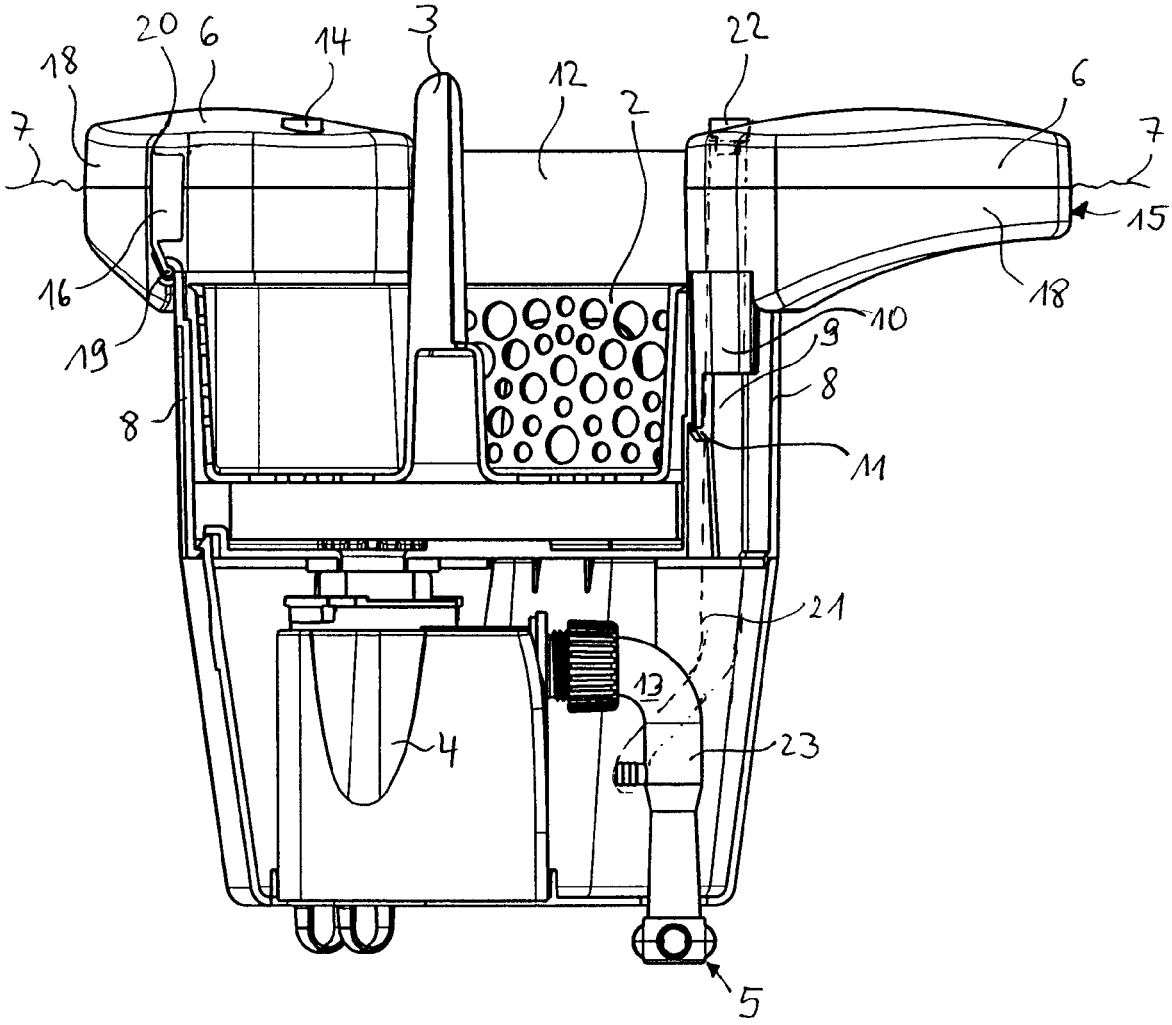
FIG. 3 is a section view in the direction III-III of the object of FIG. 2.

The aeration device for additional water or pond aeration is realized in the illustrated embodiment in that an air intake line 21, illustrated in dashed lines in FIGS. 1 and 3, extends from the intake opening 22 above the water surface 7 to an air outlet opening that coincides with the water outlet 5 in the illustrated embodiment. Preferably, the air intake line 21 extends through one of the float bodies 6. In the other float bodies 6 the corresponding opening is closed by means of a plug 14. A section of the water return line 13 extending from the pump 4 to the water outlet 5 acts as an injector 23 so that by means of the same pump 4 simultaneously air is sucked in and an oxygen enrichment of the water is realized. A water/air mixture thus exits from the water outlet or the air outlet opening 5.

The air outlet opening 5 is preferably oriented such that at least substantially no air will rise within the area of the intake flap 16 because the rising air bubbles could impair the intake of the dirt floating on the water. In the illustrated embodiment, the air outlet opening 5 is therefore advantageously arranged on the side of the housing 1 opposite the intake flap 16. As illustrated, it can be provided with several exits and the water/air mixture, as illustrated, can exit e.g. in two directions at an angle. The water/air mixture that exits from the combined water outlet and air outlet opening 5 thus fulfills additionally a certain driving action thus assisting the desired movement of the vacuum skimmer on the water surface 7; in this way, a uniform dirt removal from all areas of the water is realized.

The vacuum skimmer according to the invention is utilizable in an especially flexible way but is at the same time of a simple configuration and extremely reliable. By means of the simultaneous surface dirt removal and oxygen enrichment by means of the aeration device, the vacuum skimmer provides a significantly improved water quality. The combination of both functions and their operation with only one pump provides synergies with regard to design and energy consumption as well as by the water and air movement of the aeration device enhancing the skimmer function.

The specification incorporates by reference the entire disclosure of German priority document 10 2007 011 972.2 having a filing date of Mar. 9, 2007.

While specific embodiments of the invention have been shown and described in detail to illustrate the inventive principles, it will be understood that the invention may be embodied otherwise without departing from such principles.

What is claimed is:

1. A vacuum skimmer for a body of water, the vacuum skimmer comprising:

a housing with an upper intake opening and a dirt collecting container arranged downstream of the intake opening;

a pump arranged in the housing downstream of and below the dirt collecting container, wherein water to be purified is sucked by the pump vertically through the dirt collecting container;

an aeration device for aerating the body of water;

wherein the intake opening is provided on one side of the housing and wherein the vacuum skimmer is movable in such a way that the intake opening upon operation of the vacuum skimmer orients itself in different directions;

wherein the aeration device is operated by the pump; and wherein the aeration device has an air intake line that has an intake opening arranged above a water surface of the body of water and an air outlet opening arranged below the water surface.

2. The vacuum skimmer according to claim 1, further comprising a water return line connected to the pump and having a water outlet that is arranged below the water surface, wherein the air intake line is connected to the water return line and wherein the water outlet is the air outlet opening.

3. The vacuum skimmer according to claim 1, wherein the air outlet opening is designed such that at least substantially the air does not rise within an intake area of the intake opening.

4. The vacuum skimmer according to claim 3, wherein the air outlet opening is oriented substantially to a side of the housing opposite the intake opening.

5. The vacuum skimmer according to claim 1, further comprising float bodies connected to the housing, wherein the air intake line extends through a first one of the float bodies and the intake opening is provided in said first float body.

6. The vacuum skimmer according to claim 1, wherein the intake opening has a pivotably arranged intake flap whose upper edge delimits the intake opening, wherein the intake flap is mounted to be height-variable relative to the housing.

7. The vacuum skimmer according to claim 1, configured to be self-supporting on water.

8. The vacuum skimmer according to claim 7, comprising float bodies connected to the housing.

9. The vacuum skimmer according to claim 8, wherein the housing has recesses and the float bodies are connected to the housing by being inserted into the recesses.

10. The vacuum skimmer according to claim 8, wherein at least the float bodies neighboring the intake opening are configured as flow guiding elements that deflect an incoming water flow toward the intake opening.

11. The vacuum skimmer according to claim 10, wherein the intake opening is arranged essentially in a direction of extension of float bodies neighboring the intake opening.

12. The vacuum skimmer according to claim 7, wherein the float bodies are essentially of a biconvexly pointed shape.

13. The vacuum skimmer according to claim 1, comprising at least one purifying device selected from the group consisting of a filter and a biological purifying device.

* * * * *